US005377575A

United States Patent [19]

Huth, III

[11] Patent Number: 5,377,575

[45] Date of Patent: Jan. 3, 1995

[54] PERCUSSION INSTRUMENT

[76] Inventor: John T. Huth, III, 6226 Curie St., New Orleans, La. 70122

[21] Appl. No.: 198,611

[22] Filed: Feb. 18, 1994

[51] Int. Cl.[6] ..... G10D 13/08; G10D 13/02; A63H 5/00

[52] U.S. Cl. ..... 84/402; 84/418; 446/419; 446/421; D17/22

[58] Field of Search ..... 84/402, 403, 404, 406, 84/418; 446/418, 419, 421; D17/22

[56] References Cited

U.S. PATENT DOCUMENTS

| | | | |
|---|---|---|---|
| 3,566,737 | 3/1971 | Gussak | 84/402 |
| 3,635,120 | 1/1972 | Koishikawa | 84/418 |
| 4,269,105 | 5/1981 | Salmon | 84/418 |

*Primary Examiner*—Michael L. Gellner
*Assistant Examiner*—Cassandra C. Spyrou
*Attorney, Agent, or Firm*—George A. Bode; Michael L. Hoelter

[57] ABSTRACT

A hand-held percussion instrument capable of generating a variety of different sounds upon demand. These sounds including the typical sound of cymbals coming from a tambourine, the sound of a drum which is stretched over an open side of a tambourine, the sound of a maraca which is generated from a multitude of pellets contained within a hollow chamber inside the handle, this sound being adjusted by selectively covering or uncovering openings in the handle, and the sound of a lone cymbal set located at the end of the handle some distance from the tambourine.

20 Claims, 4 Drawing Sheets

PERCUSSION INSTRUMENT

BACKGROUND OF THE INVENTION

1. Field of the Invention

The present invention pertains to musical instruments in general and, more particularly, to a new design for a tambourine that offers the user the ability to make a variety of different sounds, or combine such sounds, as needed.

2. General Background

The use of a tambourine as a musical instrument has a long history. In perhaps its most common form, the tambourine is configured as an open circular ring with multiple sets of small cymbals or jingle elements loosely supported about the ring. As the tambourine is shaken or moved, these cymbal sets strike each other thereby making the desired sound.

This typical shape for the tambourine was often enhanced by stretching a material over one open end of the circular ring. Consequently, the tambourine was transformed into a drum that was struck to make the desired sound.

One improvement to the classical style of the tambourine is shown in U.S. Pat. No. 1,333,565 issued to Newlin which not only incorporates multiple sets of small cymbals and a drum cover, but also a series of flexible arms or tines that are moved by a bar to beat against the drum. While an unusual sound is created, this variation would cause the drum to wear excessively at the point of contact with the arms or tines.

U.S. Pat. No. 1,576,443 issued to McElhany discloses a generally triangular shaped tambourine with multiple sets of cymbals mounted in generally orthogonal planes. Additionally, a series of castanets are detachably secured to the mid-region of the tambourine for the creation of a unique sound.

U.S. Pat. No. 3,566,737 issued to Gussak discloses a design that incorporates two sets of cymbals linearly positioned along parallel elongated support members. Mounted between and to one side of these parallel support members is a pellet container containing pellets which generates sounds somewhat similar to a maraca. Thus, depending upon the direction in which the instrument is shaken, various sounds can be achieved.

U.S. Pat. No. 4,150,602 issued to Santiago, Sr. consists of a flat paddle with openings for the insertion of cymbal sets therein. Also, a central opening contains a single pair of cymbals for the creation of a distinctive sound.

U.S. Pat. No. 3,704,340 issued to Hall discloses a rhythm trap which consists of an elongated rod upon which a classical styled round tambourine, a series of bells, and a single cymbal are secured. By striking this rod upon the ground, a variety of sounds are created.

While each of the above variations produce their own unique sound, none of them disclose or teach the unique sound and/or structure now disclosed. It is thus an object of this invention to provide a new style of hand-held tambourine that can create a variety of sounds.

Another object of this invention is to provide a tambourine whose sounds can be selectively created if desired such that only a single sound can be generated or multiple sounds can be created.

Yet another object of the invention is to provide the user with control over which of the several possible sounds are to be made. Still another object of this invention is to provide a tambourine that is simple to construct and easy to hold yet still enable the user to select which sound is to be generated. These and other objects and advantages of this invention will become apparent upon further investigation.

SUMMARY OF THE PRESENT INVENTION

The preferred embodiment of the apparatus of the present invention solves the aforementioned problems in a straightforward and simple manner. What is provided is a hand-held percussion instrument which incorporates a tambourine containing a plurality of cymbal sets therein. These cymbal sets are spaced about the tambourine intermediate first and second open sides of the tambourine. A handle is secured to the tambourine and projects away from the tambourine with this handle having a series of openings therein. A hollow chamber is located within the handle with this hollow chamber containing a multitude of individual pellets therein. Located at the distal end region of the handle is a separate cymbal set which can be activated as needed. Consequently, this percussion instrument can be moved to produce one or more of a variety of different sounds, such sounds including the sound of the cymbal sets spaced about the tambourine, the sound of a maraca generated from the individual pellets contained in the hollow chamber, such sound being adjustable by the selective covering or uncovering of the openings in the handle, and the sound of the offset cymbal set.

BRIEF DESCRIPTION OF THE DRAWING

For a further understanding of the nature and objects of the present invention, reference should be had to the following description taken in conjunction with the accompanying drawing in which like parts are given like reference numerals and, wherein.

DETAILED DESCRIPTION OF THE PREFERRED EMBODIMENT

Figure 1:
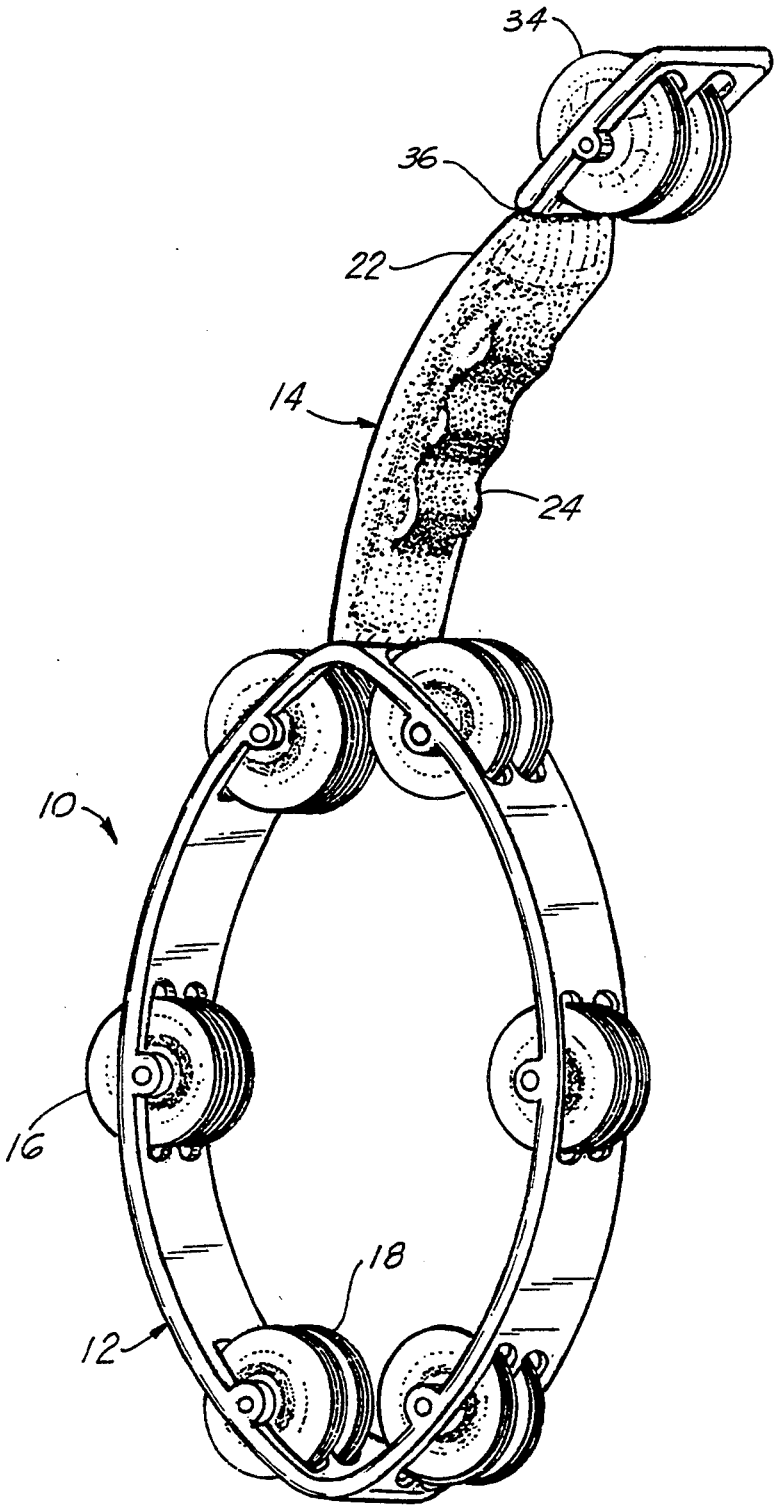
FIG. 1 is a front pictorial view of the preferred embodiment of the apparatus of the present invention.

Referring initially to FIGS. 1–6, there is shown hand-held percussion instrument 10. As illustrated, percussion instrument 10 consists of a modified tambourine end region 12 and a handle end region 14 secured thereto. The exact configuration of both tambourine end region 12 and handle end region 14 may be different from that shown if so desired. Furthermore, both tambourine end region 12 and handle end region 14 may be constructed of similar materials (i.e. wood, plastic, metal, bamboo, etc.) or they may be constructed of different materials.

Tambourine end region 12 is shown as being configured in the shape of an ellipse or possibly "football" shaped, however, other configurations such as "egg"

shaped, circular, or otherwise are equally suitable. Around the perimeter of tambourine end region 12 and intermediate its open sides are a series of cymbal sets 16 which make a desired noise upon being moved or struck. Each of these cymbal sets 16 are generally constructed of a plurality of thin disks 18 that are loosely secured along a common axis. These thin disks 18 are generally constructed of metal and they may be planer or they may incorporate a curved region so as to produce a certain sound. With this configuration, as tambourine end region 12 is shook, these individual metal disks 18 strike each other thereby making the sound associated with their individual shape and/or configuration.

Figure 2:
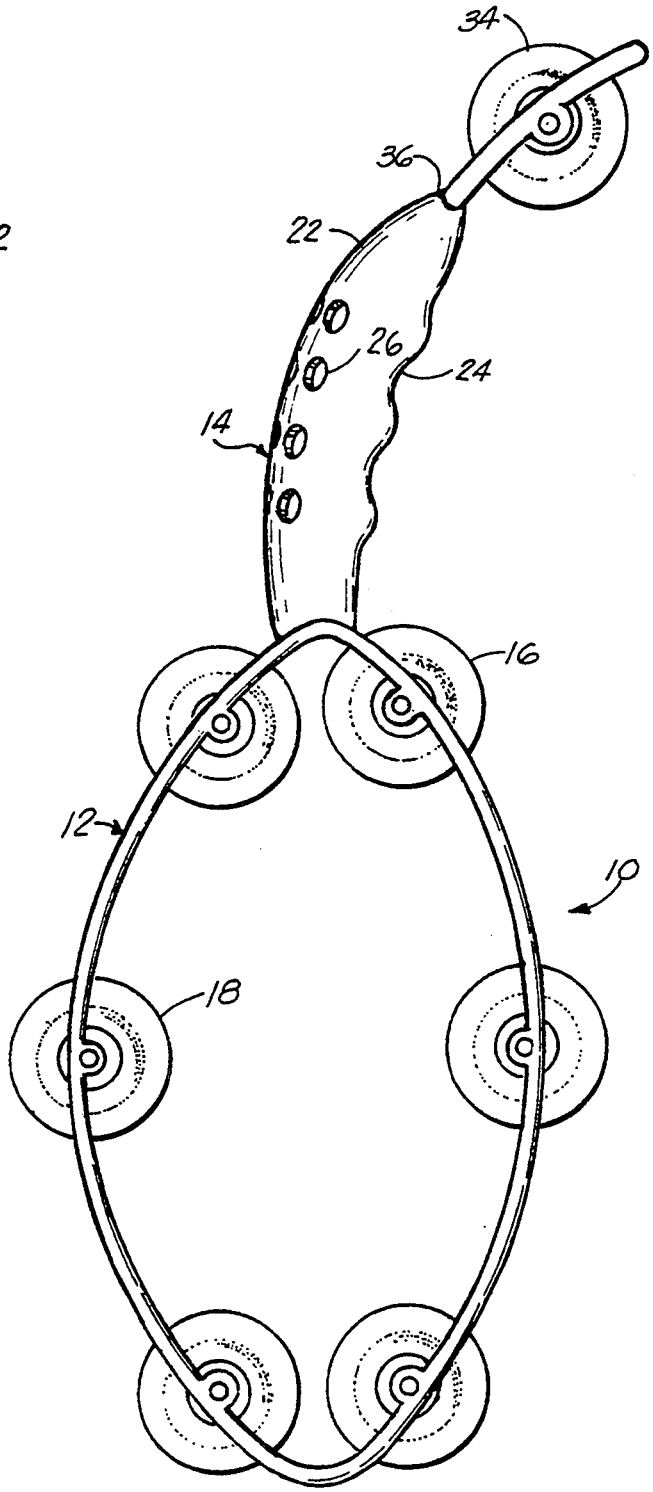
FIG. 2 is a plan view of the invention.

As shown in FIGS. 1 and 2, there are six different symmetrical locations about the perimeter of tambourine end region 12 where such cymbal sets 16 are located. More or fewer such locations may be desired as needed and they may be non-symmetrically spaced if so desired. The six locations shown in the drawings are merely for the purpose of illustration and are not intended for limitation.

Figure 3:
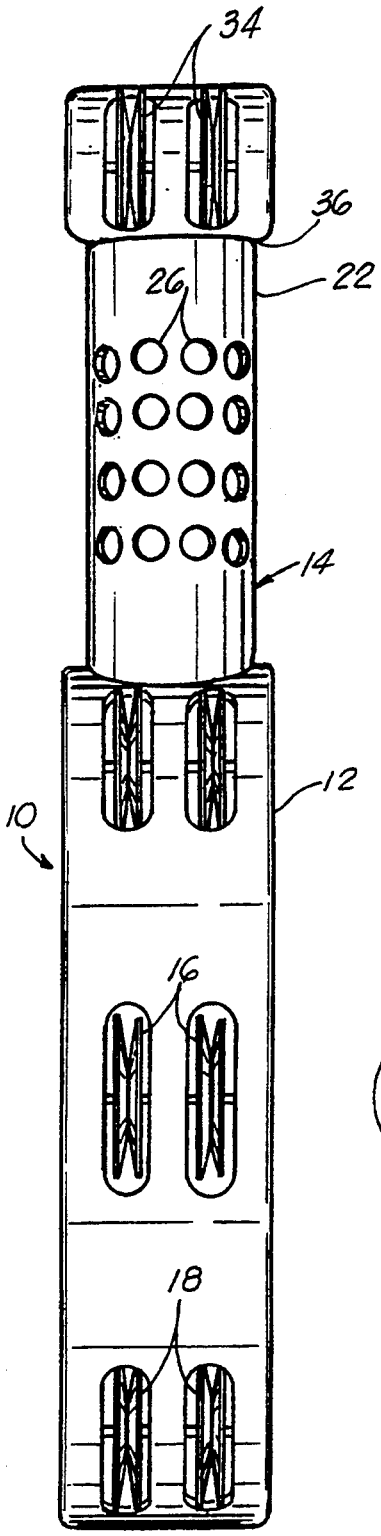
FIG. 3 is a top side view of the invention.
Figure 4:
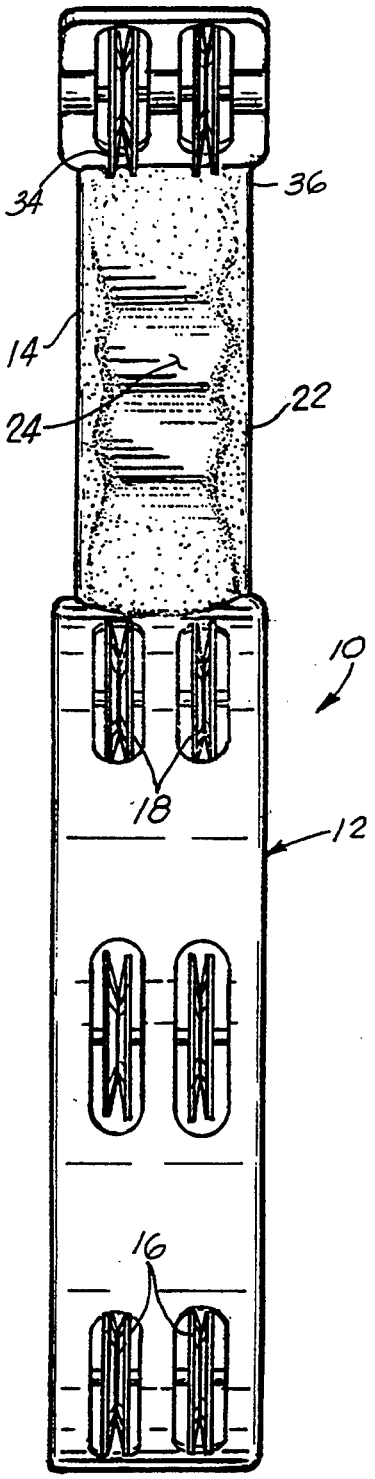
FIG. 4 is a bottom side view of the invention.
Figure 5:
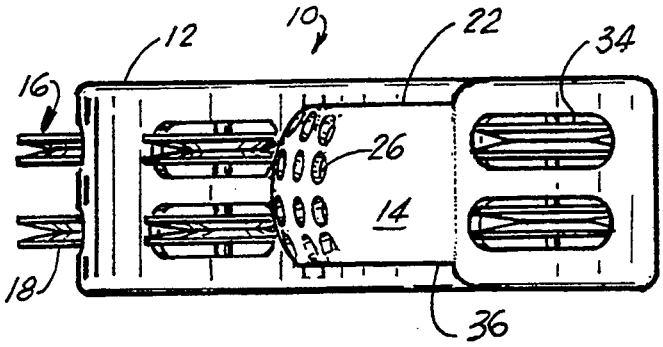
FIG. 5 is handle end view of the invention.
Figure 6:
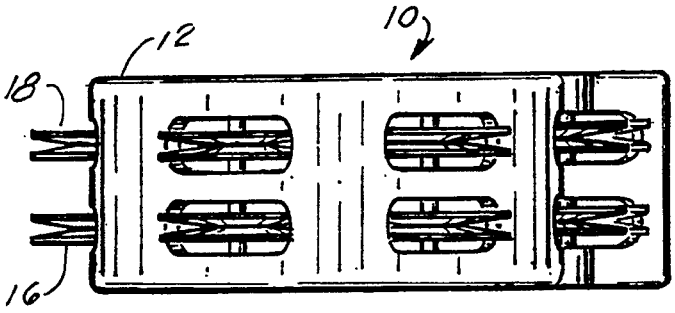
FIG. 6 is a tambourine end view of the invention.

FIGS. 3 and 4, further disclose that each such cymbal set 16 may consist of two separate pairs of disks 18 that are co-axially aligned at each of these six locations about tambourine end region 12 if so desired. More or fewer such pairs of disks 18 may be incorporated as desired and these different pairs of disks 18 may be offset from each other rather than being co-axially positioned if so desired.

Figure 7:
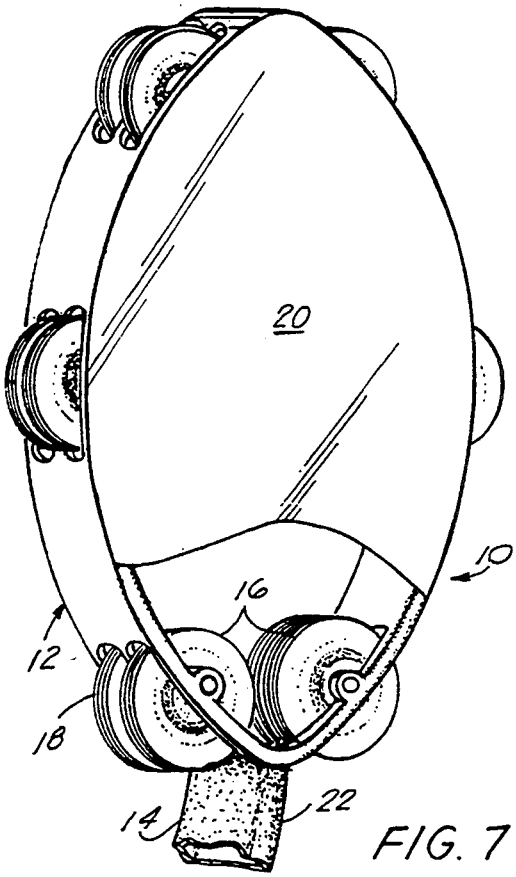
FIG. 7 is a pictorial view, partially broken away, of an alternate embodiment of the invention.

FIG. 7 illustrates a further embodiment of percussion instrument 10. In this embodiment, a thin material or skin 20, such as vellum or any other suitable covering, is stretched across one open side of tambourine end region 12 thereby closing it to form a drum-like instrument. As a result, this thin material or drum 20 can be struck as desired to make the accompanying sound.

Handle end region 14 is shown connected to tambourine end region 12 at an apex of this region 12. Other locations of attachment are equally suitable. Handle end region 14 is illustrated as consisting of a hollow curved hand grip 22 having finger indentations 24 along one side and a series of spaced openings 26 along an opposite side. Ideally, hand grip 22 would be constructed of a material that would permit percussion instrument 10 to be held, moved, and shook without any slippage between the user and this hand grip 22. Such material might include a rubber or foam padding inserted around hand grip 22 or the hand grip 22 might incorporate a knurled or roughened texture.

Figure 8:
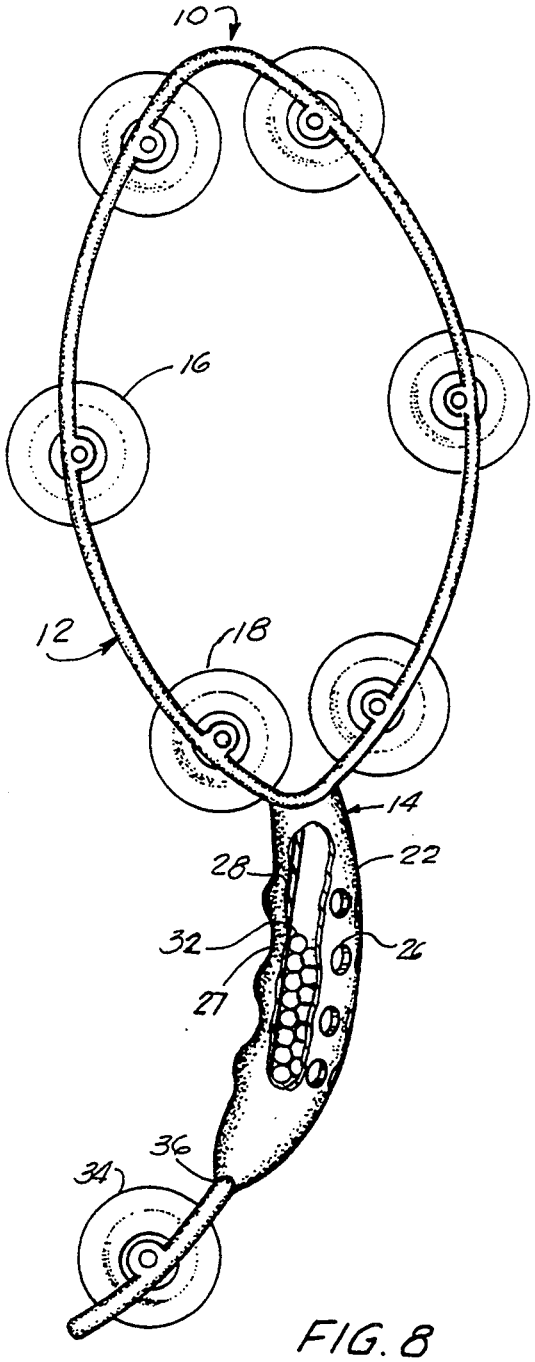
FIG. 8 is a plan view, partially broken away, of the invention.
Figure 9:
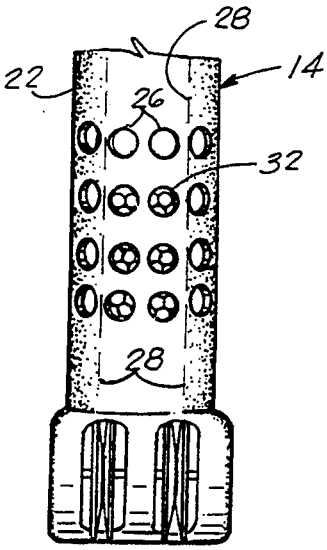
FIG. 9 is a top side view, partially broken away, of the handle of the invention; and, FIG. 10 is a plan view, partially broken away, of the internal chamber within the handle.
Figure 10:
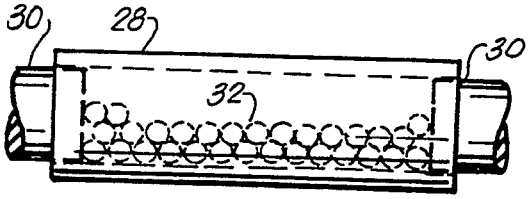

As shown in FIGS. 8–10, within hand grip 22 is a hollow chamber 28. This chamber 28 is sealed at both ends such as by plugs 30 and is filled with a multitude of small pellets 32, such as metal shot. Consequently, as hand grip 22 is moved, these small pellets 32 move within chamber 28 thereby striking each other, the interior chamber walls, and end plugs 30. Thus, by selectively choosing the material of hollow chamber 28, plugs 30, and pellets 32, a distinctive and unique sound can be generated simply by moving hand grip 22. In this embodiment, chamber 28 and plugs 30 are constructed of metal while pellets 32 consist of lead shot, however other materials may be used to generate the desired sound, which is similar to a maraca.

A further refinement of this percussion instrument 10 is the incorporation of openings 26 in hand grip 22. By selectively covering and uncovering these openings 26 while hand grip 22 is being moved, the maraca sounds generated within hollow chamber 28 are either amplified or muffled. To accomplish this, the user need only move one or more fingers enveloping hand grip 22 thereby covering or uncovering openings 26 depending on whether the sounds generated within hand grip 22 are to be enhanced or dampened.

As also shown in the drawings is an offset cymbal set 34 secured to distal end region 36 of hand grip 22. This offset cymbal set 34 is illustrated as consisting of two separate pairs of cymbals or disks 18 slightly spaced from each other but co-axially aligned as shown. More or fewer such sets may be incorporated as desired. However, their position with respect to each other is similar to the location and position of the other cymbal sets 16 and individual disks 18 located about tambourine end region 12. This offset cymbal set 34 can be constructed identical to the other cymbal sets 16 in percussion instrument 10 or this offset cymbal set 34 can be made larger or smaller, or with a different curvature, so as to generate a different sound as desired. Additionally, offset cymbal set 34 (and the same applies to the other cymbal sets 16) may consist of three or more such individual disks 18 positioned to strike adjacent disks 18 if so desired.

Consequently, percussion instrument 10 can be used to generate a variety of different sounds. First, percussion instrument 10 can be operated as a typical tambourine with only the sounds of cymbal set 16 in tambourine end region 12 striking each other. Second, percussion instrument 10 can be played as a drum by striking the thin material 20 stretched across tambourine end region 12. Third, the sound of a maraca can be generated by moving the multitude of pellets 32 within hollow chamber 28. Fourth, this maraca sound can be modified or controlled by selectively covering or uncovering openings 26 in hand grip 22. And fifth, offset cymbal set 34 can be shook to create a different sound as needed. Thus, percussion instrument 10 is capable of creating any or all of these sounds, either individually or collectively, as the situation demands.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A hand-held instrument comprising:

(a) a tambourine portion containing a plurality of first cymbal sets spaced thereabout intermediate first and second open sides;

(b) a hollow handle having a proximate end portion and a distal end region opposite said proximate end portion and secured at said proximate end portion to said tambourine portion and projecting away from said tambourine portion, said handle having a plurality of openings therein;

(c) a hollow chamber located within said hollow handle and containing a plurality of individual pellets therein;

(d) a second cymbal set mounted to the distal end region of said handle; and, (e) whereby said instrument can be moved to produce one or more of a variety of different sounds, the sounds comprising a sound of said first cymbal sets spaced about said tambourine portion, a maraca-type sound generated from said plurality of pellets contained in said hollow chamber, the maraca-type sound being adjustable by selectively covering or uncovering said openings in said handle, and a sound of said second cymbal set mounted to the distal end region of said handle.

2. The instrument as set forth in claim 1, further comprising a thin material stretched across and covering one of said open sides of said tambourine, thereby forming a drum-like instrument portion to thereby permit another sound to be generated as desired.

3. The instrument as set forth in claim 1, wherein said tambourine portion is elliptical in shape and wherein said handle is secured to said tambourine at one apex of said ellipse.

4. The instrument as set forth in claim 1, wherein said plurality of first cymbal sets secured to said tambourine portion are symmetrically spaced about the perimeter of said tambourine portion.

5. The instrument as set forth in claim 1, wherein each of said first cymbal sets comprises two or more pairs of co-axially aligned disks supported about the perimeter of said tambourine portion.

6. The instrument as set forth in claim 1, wherein said handle is configured with indentations, adapted to accept human fingers, provided in a portion opposite said openings in said handle.

7. The instrument as set forth in claim 1, wherein said second cymbal set comprises two or more pairs of co-axially aligned disks supported at the distal end region of said handle.

8. The instrument as set forth in claim 1, wherein said second cymbal set is identical with said first cymbal sets spaced about said tambourine portion.

9. The instrument as set forth in claim 1, wherein said second cymbal set differs from said first cymbal sets spaced about said tambourine portion, whereby said second cymbal set produces a different sound than the sound produced by said first cymbal sets spaced about said tambourine portion.

10. The instrument as set forth in claim 1, wherein said individual pellets are constructed of metal shot.

11. A hand-held instrument comprising:

(a) a tambourine portion containing a plurality of first cymbal sets symmetrically spaced about its perimeter and intermediate first and second open sides;

(b) a hollow handle having a proximate end portion and a distal end region opposite said proximate end portion and secured at said proximate end portion to said tambourine portion and projecting laterally away from said tambourine portion, said handle having a plurality of openings in one portion thereof;

(c) a hollow chamber located within said hollow handle and containing a plurality of individual pellets therein;

(d) a second cymbal set mounted to the distal end region of said handle; and, (e) whereby said instrument can be moved to produce one or more of a variety of different sounds, the sounds comprising a sound of said first cymbal sets spaced about said tambourine portion, a maraca-type sound generated from said plurality of pellets contained in said hollow chamber, the maraca-type sound being adjustable by selectively covering or uncovering said openings in said handle, and a sound of said second cymbal set mounted to the distal end region of said handle.

12. The instrument as set forth in claim 11, further comprising a thin material stretched across and covering one of said open sides of said tambourine, thereby forming a drum-like instrument portion to thereby permit another sound to be generated as desired.

13. The instrument as set forth in claim 11, wherein said tambourine portion is elliptical in shape and wherein said handle is secured to said tambourine at one apex of said ellipse.

14. The instrument as set forth in claim 11, wherein each of said first cymbal sets comprises two or more pairs of co-axially aligned disks supported about the perimeter of said tambourine portion.

15. The instrument as set forth in claim 11, wherein said handle is configured with a plurality of indentations, adapted to accept human fingers, provided in a portion opposite said openings in said handle.

16. The instrument as set forth in claim 11, wherein said second cymbal set comprises two or more pairs of co-axially aligned disks supported at the distal end region of said handle.

17. The instrument as set forth in claim 11, wherein said second cymbal set is identical with said first cymbal sets spaced about said tambourine portion.

18. The instrument as set forth in claim 11, wherein said second cymbal set differs from said first cymbal sets spaced about said tambourine portion, whereby said second cymbal set produces a different sound than the sound produced by said first cymbal sets spaced about said tambourine portion.

19. The instrument as set forth in claim 11, wherein said individual pellets are constructed of metal shot.

20. A hand-held instrument comprising:

(a) a elliptically-shaped tambourine portion containing a plurality of first cymbal sets symmetrically spaced about its perimeter and intermediate first and second open sides;

(b) a hollow handle having a proximate end portion and a distal end region opposite said proximate end portion and secured at said proximate end portion to said tambourine portion and projecting laterally away from said tambourine portion, said handle having a plurality of openings in one portion thereof and a plurality of indentations, adapted to accept human fingers, provided in a portion opposite said openings;

(c) a hollow chamber located within said hollow handle and containing a plurality of individual pellets therein;

(d) a second cymbal set mounted to the distal end region of said handle; and, (e) whereby said instrument can be moved to produce one or more of a variety of different sounds, the sounds comprising a sound of said first cymbal sets spaced about said tambourine portion, a maraca-type sound generated from said plurality of pellets contained in said hollow chamber, the maraca-type sound being adjustable by selectively covering or uncovering said openings in said handle, and a sound of said second cymbal set mounted to the distal end region of said handle.

* * * * *